United States Patent [19]

Wiley

[11] Patent Number: 4,819,884

[45] Date of Patent: Apr. 11, 1989

[54] MEANS OF PNEUMATIC COMMINUTION

[75] Inventor: Allen C. Wiley, Coralville, Iowa

[73] Assignee: MicroFuel Corporation, Coralville, Iowa

[21] Appl. No.: 138,363

[22] Filed: Dec. 24, 1987

Related U.S. Application Data

[63] Continuation-in-part of Ser. No. 697,042, Jan. 31, 1985.

[51] Int. Cl.[4] ..... B02C 19/00

[52] U.S. Cl. ..... 241/39; 241/300

[58] Field of Search ..... 241/300, 40, 43, 45, 241/39

[56] References Cited

U.S. PATENT DOCUMENTS

| | | | |
|---|---|---|---|
| 1,959,703 | 5/1934 | Birhmann . | |
| 2,765,748 | 10/1956 | Buchi . | |
| 2,784,936 | 3/1957 | Schmidt . | |
| 2,973,894 | 3/1961 | Kimball et al. . | |
| 3,186,650 | 6/1965 | Dixon et al. | 241/300 X |
| 3,206,807 | 9/1965 | Hoffman et al. . | |
| 3,255,793 | 6/1966 | Clute | 241/39 X |
| 3,260,443 | 7/1966 | Garnett et al. . | |
| 3,362,338 | 1/1968 | Stethem . | |
| 3,381,621 | 5/1968 | Luhmann et al. . | |
| 3,381,901 | 5/1968 | Foch . | |
| 3,425,638 | 2/1969 | Doyle et al. . | |
| 3,675,858 | 7/1972 | Stephanoff . | |
| 3,973,733 | 8/1976 | Switzer . | |
| 3,973,872 | 8/1976 | Selznev et al. . | |
| 4,108,572 | 8/1978 | Platt . | |
| 4,109,688 | 8/1978 | Akunov et al. . | |
| 4,131,239 | 12/1978 | Stephanoff . | |
| 4,167,369 | 9/1979 | Isihara . | |
| 4,189,102 | 2/1980 | Andrews . | |
| 4,219,164 | 8/1980 | Taylor . | |
| 4,248,387 | 2/1981 | Andrews . | |
| 4,288,166 | 9/1981 | Nakabayashi et al. . | |
| 4,318,672 | 3/1982 | Hansen . | |
| 4,364,712 | 12/1982 | Charles . | |
| 4,381,171 | 4/1983 | Chapple . | |
| 4,390,131 | 6/1983 | Pickrel . | |
| 4,418,871 | 12/1983 | Powell . | |
| 4,520,541 | 6/1985 | Miki et al. . | |
| 4,538,764 | 9/1985 | Dunbar . | |
| 4,602,745 | 7/1986 | Maliszewski et al. | 241/117 X |
| 4,634,344 | 1/1987 | Zagar et al. . | |
| 4,653,976 | 3/1987 | Blair et al. . | |
| 4,659,288 | 4/1987 | Clark et al. . | |
| 4,671,740 | 6/1987 | Ormiston et al. . | |
| 4,678,131 | 7/1987 | Rankin, III | 241/300 X |

FOREIGN PATENT DOCUMENTS

| | | | |
|---|---|---|---|
| 2738980 | 3/1979 | Fed. Rep. of Germany | 241/40 |

*Primary Examiner*—Timothy V. Eley
*Assistant Examiner*—Joseph M. Gorski
*Attorney, Agent, or Firm*—Hill, Van Santen, Steadman & Simpson

[57] ABSTRACT

An improved centrifugal pneumatic comminutor including a housing containing a fan operatively connected to a motor, the housing having an inlet opening aligned with the axis of the fan and an outlet opening on the perimeter of the housing, an input conduit mounted to the housing surrounding the inlet opening including a frustal conically shaped section adjacent the housing, and an output conduit attached to the housing surrounding the outlet opening, the material to be comminuted being introduced into the input conduit and being drawn into the frustal conically shaped section by suction of the fan. The materials are comminuted in the input conduit in a rotational impact area directly below the fan and thereafter are pulled through the fan and forced out the output conduit by the pressure of the fan. The fan includes a ring member attached to the fan which rotatably mates with a journal attached to the housing creating an air lock through the comminutor. Further improvements in comminution of the invention include improving the air lock through the system, putting abrasive surfaces on various components to increase grinding action of the particles, and varying the shape of the inside surfaces to promote complete comminution.

11 Claims, 8 Drawing Sheets

7-7

MEANS OF PNEUMATIC COMMINUTION

CROSS-REFERENCE TO RELATED APPLICATION

This application is a continuation-in-part application from co-owned and co-pending U.S. Ser. No. 697,042, entitled MEANS AND METHOD OF PNEUMATIC COMMINUTION, filed Jan. 31, 1985 by the present inventor.

BACKGROUND OF THE INVENTION

1. Field of the Invention

This invention relates to a means and method for improved pneumatic comminution, in particular, a means and method of pneumatically comminuting various materials with improved control and results.

2. Problems in the Art

Comminution, the pulverization or breaking apart of materials into small parts, is a significant operation in many industries, particularly the coal and cement industries which require tremendous amounts of crushing and grinding. However, current comminution technology used by industry is both energy intensive and inefficient. Annual electrical energy consumption in size reduction operations by United States industry is approximately 32 billion kilowatt hours (KWH). More than half of this energy is consumed in the crushing and grinding of minerals. An additional 3.7 billion KWH per annum is contained in energy inconsumables, such as grinding media and liners. The total amount of energy approaches 2% of the national electric power production.

The amount of energy used by United States industry to produce its products not only contributes to that cost of production, but also is a factor in the end products' marketability on world markets. A study of United States industries reveals that the cost of a commodity intended for both national and international markets is closely associted with the cost of energy required to manufacture that commodity. These energy costs are particularly high in the primary metals, chemical, food, paper and petroleum industries All of these industries rely heavily upon particle size reduction operations, which is therefore a significant contribution to product cost. It can therefore be seen that there exists a continuing need for improvements in comminutors, and energy consumption in the comminution process Two vivid examples are the coal and cement industries.

It is well known that using coal as an energy source presents several barriers preventing its widespread use. Among these are derating of a boiler burning natural gas or oil, more elaborate handling and combustion facilities, and expensive pollution control. Investigations concerned with coal combustion and pollution control show promise of removing these barriers without significant cost increases. Thus, the price of coal should remain favorable and yield widespread usage of coal.

It is known in the art that micronized coal burns more efficiently than lump coal. Micronized coal is lump coal which is disintegrated to micron sized particles. Micronized coal also provides for easier handling, more efficient, complete and controllable combustion, and an opportunity to reduce particulate emissions.

A micronized coal particle has a larger surface per unit volume, thereby increasing the burning rate. Micronized coal burns much like a No. 2 oil, suggesting that retrofitting can be accomplished by replacement of the oil or gas burner with a coal burner, and derating of a furnace is unnecessary. Further development of techniques for combustion systems using micronized coal and applications of these techniques to industrial size furnaces is in process.

It is interesting to note that studies have shown that the critical pollution problem involved with the sulfur content in coal can be controlled or eliminated by injecting limestone into the coal during the combustion process. The calcium reacts with the sulfur to produce calcium sulfate particles which are removed with the ash, using conventional particle gas separators. To facilitate injection of the limestone, it too must be micronized. The combined micronized limestone and coal represents a viable method of reducing both energy costs, through use of coal, and sulfur dioxide pollutants by the sulfur calcium reaction. There is therefor a continuing need for an apparatus which will allow efficient and economical coal micronization.

Micronized coal of the size between 5 micrometers ($\mu$m) and 30 $\mu$m is more advantageous than the particles produced by conventional pulverizers where particle sizes range from 50 to 150 $\mu$m. The centrifugal comminutor of this invention will efficiently and economically produce coal particles between 5 $\mu$m and 30 $\mu$m in diameter.

A second major advantageous use for comminution exists in the cement industry In the cement industry, the surface area per unit weight has become a standard for characterizing cement quality. Acceptable fineness is around 3,200 to 5,200 $cm^2$ per gram ($cm^2/gm$) of cement. This measurement, known as Blaine Surface Measurement, is made by measuring the pressure drop which results from the flow of air through a standard packed bed of cement.

Recent studies have shown that the particle size of cement is important, based upon the following findings (1) by controlling the cement particle size to below 20 $\mu$m, with a Blaine area of only 2600 $cm^2/gm$, strengths equaling that of normally ground cements of 3600 $cm^2/gm$ Blaine area can be achieved; (2) The amount of ground clinker in a 2.5 $\mu$m particle size range has large effects on bleeding, water requirements for flow, and strength of development; (3) Controlled product particle size of cement grinding results in cements of as high or higher strengths at ages from 1–60 days at Blaine areas of 450–800 $cm^2/gm$, substantially lower than the normal grinds of the same composition.

It is estimated that the adoption of particle size control in clinker grinding by the entire United States cement industry would result in a 27% saving in grinding energy, and an 8.5% savings in kiln fuel. To achieve such control, however, reliable on-line (real time) particle size and specific surface measurement devices need to be developed. The centrifugal comminutor of this invention can be success fully used in the cement industry.

It is generally believed that high specific surface areas produce high strength cement. The actual particle size distributions also influence cement strength. The particle sizes that have the greatest effect of cement strength are 5 to 30 $\mu$m.

By comminuting the elements of cement, namely, limestone and clinker in the comminutor of this invention, improvements in cement quality and savings in energy consumed in producing cement can be achieved.

In other areas too, besides coal and cement, a tremendous energy savings could be realized by reducing energy consumption for other comminuted products.

For example, comminution is utilized on a significant scale for many other commodities including, but not limited to, the following: aluminum, arsenic, asbestos, barite, boron, calcium, ceramics, chromium, clays, copper, diatomite, feldspar, fluorspar, golds, grain, gypsum, iron ore, lead, lithium, magnesium, manganese, mercury, mica, molybdenum, nickel, perlite, phosphate, potassium, pumice, rae earth, sand and gravel, salts, silicon, silver, a stone, chalk, titanium, tungsten, uranium, vermiculite, and zinc. It is estimated that the energy used for comminution of these materials approaches 33 billion kilowatt hours per year.

Existing technology utilizes such apparatuses as ball mills, rod mills, roll mills, autogenous mills, and hammer mills as fine grinders; and attrition and fluid energy mills as ultrafine grinders. The tremendous cost of these devices centers not only on their operating energy consumption, but also on their capital costs, maintenance, metal loss from attrition of moving parts with the material being comminuted, and ancillary equipment which is needed to operate in conjunction with these devices.

The present invention represents a significant improvement over the above mentioned conventional comminutors as it utilizes pneumatics and particle-to-particle attrition for both input and output conveyance of the material and comminution of the material, respectively.

Pneumatic or vacuum comminution, was the subject of U.S. Pat. No. 3,255,793, issued to Clute on June 14, 1966. Clute attempted to utilize pneumatic comminution for crop grinding. Clute used a vertically rotating fan in a housing having an horizontal inlet along the horizontal fan axis. However, Clute neither encountered nor contemplated the use of this device for coal comminution or cement industry applications nor was the Clute device successful in its intended use. Furthermore, it has been found that Clute's invention was and is not successful because of problems with the pneumatics and because of excessive and unacceptable metal loss from the blades of fans. The device of this invention accomplishes much smaller size reduction than Clute when comparable energy is expended, with significantly reduced wear.

In the centrifugal action of the present improved comminutor, its non-uniform acceleration of various massed particles causes particle-to-particle attrition of the material in the area directly before the fan (called the rotational impact zone or RIZ). Thus, comminution is substantially achieved prior to the particles passing through the rotary fan. As a result, metal wear is lessened considerably.

The present application, a continuation-in-part from U.S. Ser. No. 697,042, improves further on that copending application by further improving the control of the air flow through the comminutor and the action of the particles being comminuted to produce more accurate and uniform final product particle size.

SUMMARY OF THE INVENTION

The present invention provides a means and method of significantly economizing energy use and capital costs associated with comminution technology, while at the same time providing accurate and uniform-in-size comminution, with minimal metal loss to the comminuting device.

These advances over Clute are possible by virtue of the improved structure and methods of this invention. Improvements in the structure include inter alia modification of the fan and fan blade structure and their association with the fan housing, horizontal placement and rotation of the fan, variations in the dimensions and relationship of the cone leading into the fan housing as to fan size and speed; and tailoring of the structure and method to enhance performance with minerals and other products.

The present invention includes a fan means rotatably connected to a power source and enclosed within a fan housing. The axle of the fan extends upwardly through the top of the housing, whereas an inlet opening concentrically aligned with the fan axis exists on the bottom of the housing. An outlet opening is provided along the perimeter of the fan housing.

The lowermost portion of the fan has a ring member including a flange means which is mateable in close proximity with the flange means of a journaling means mounted in the inlet opening to the fan housing. The ring member and journaling means combination assures a sealed and efficient air flow through the device by creating an air lock between the inlet, the fan housing and the outlet.

Alternatively, the mateable flange means of the ring member of the fan and the journaling means can be replaced by at least one brush ring which would be secured to the fan housing and extend radially inward to the fan which would have a corresponding groove or channel to receive the outer end of the brush ring. The brush ring would provide improved sealing action for an improved air lock, while at the same time avoiding wear problems and the costs associated with the flange means.

The method of the present invention utilizes various structural relationships to provide an improved method of comminution within the device. For example, the fan speed is variably adjustable in accordance with the throughput and is directly related to particle size output. Fan size and blade shape is related to the input cone size and shape to achieve a desired air flow and particle size. The step of providing an air lock by way of the ring and journal means, or the ring brush and fan channel combination, improves the air flow through the device, to achieve better particle-to-particle attrition.

The results of the improved structure and method of the present invention provide uniformity-in-size of comminuted particles which is accurately controllable, while at the same time minimizing or eliminating metal loss from the blades of the fan. Moreover, the means and method of the present invention allow it to be effectively operative for many different types of materials with the same results, from very hard minerals such as granite, iron ore, chromium and mica, to soft materials such as grain, clay, and the like. The present invention also is capable of producing significantly smaller uniform-in-size particles than ever previously possible.

The present invention also presents the advantages of significant economy in energy consumption per product comminuted, and significant savings in capital equipment costs, for the comminutor itself conveys, internally classifies, and comminutes, thus eliminating the need for most ancillary equipment. It can be operatively implemented into micronized coal combustion systems, cement grinding operations, and a multitude of other applications.

The present application includes further advantages and advances over those originally disclosed in copending Ser. No. 697,042 as follows. For efficient functioning of the comminutor, the air flow must be controllable and exact. One alternative to insure that no leakage of air or material being comminuted occurs between the edges of the fan and the housing is the mating flange configuration between the fan and the journal means. A further advance is to utilize an annular brush ring which extends and fits within a groove in the fan and results in an improved air lock without the wear and friction problems of the flanges. Moreover, the economy of the brush ring, and its deflectability for easy separation from the fan are further advantages.

It has also been found that some contamination of the final comminuted product occurs simply because insufficiently comminuted particles are knocked or bounced into the air flow pulling them through the fan to output. Additionally, it has been found that some reduction in size of particles is the result of contacting the walls defining the rotational impact zone. The present invention thus further improves the comminution process by presenting alternatives to enhance grinding action along the wall of the rotational impact zone, and means and methods to propel insufficiently comminuted particles back downward into the rotational impact zone for further comminution. A first alternative embodiment simply positions an abrasive surface covering the rotational impact area for grinding action. A second embodiment provides a liner in the rotational impact zone having a sloped or rounded inner-facing surfce. The inner-facing surface extends radially inward the greatest distance at its middle portion. Its upper portion nearest to the fan and the lower portion on the opposite side of the middle portion both are rounded or are sloped radially outwardly from the center of the rotational impact zone. The thicker middle section and the sloping lower portion assist insufficiently comminuted particles rotating around the upper and middle sections to migrate back down to the lower section for further comminution with larger particles. The migration of insufficiently comminuted particles is caused by the angle of incidence at which the particles strike the sloped surface, in combination with their mass. The pull of the air flow through the fan is not sufficient to overcome this combination, as it is for those particles which are sufficiently comminuted. A third embodiment utilizes a liner in the rotational impact zone which has an uneven surface, such as serrations, channels, or concave grooves, transverse to the general flow of air and material being comminuted for further grinding action. A fourth embodiment utilizes pressurized air jets to introduce streams of pressurized air tangentially to the flow of particles in the rotational impact zone to increase their speed, which increases their centrifugal action and, likewise, their comminution. A fifth embodiment utilizes a rotatable liner with an abrasive surface or uneven surface which can be operatively connected to a motor to rotate it in a direction opposite the general flow of air and materials being comminuted.

Additional advances include the alternatives of utilizing more fan blades and coating the surface of the blades with an abrasive substance. An option is also to provide replaceable abrasive edges along the lower fan blades for further grinding action. Furthermore, alternatives in the general fan blade orientation and configuration are disclosed for improved air flow and less fan wear.

It is therefore a primary object of the invention to improve over the problems and upon the deficiencies in the art of comminutors and in particular pneumatic comminutors.

A further object of the invention is to provide a means and method for comminuting materials which does so efficiently and effectively.

A further object of the invention is to provide a means and method of comminuting materials which produces uniform in-size output particles.

Another object of the invention is to provide a means and method of comminuting materials which experiences little or no metal loss in the comminutor.

Another object of the invention is to provide a means and method of comminuting materials which produces an effective airflow and creates an effective comminuting environment which combines the effects of reduced environment pressure and centrifugal force to create a rotational impact zone of varying velocity gradients just in front of the fan blade tips.

A further object of the invention is to provide a means and method of comminuting materials which provides an effective air lock throughout the device.

A further object of the invention is to provide a means and method of comminuting material which is variable in adjustment of air flow speed which as a result allows selection of particle size output.

Another object of the invention is to provide a means and method of comminuting materials which can be used for many different applications, from hard materials to soft materials.

Another object of the invention is to provide a means and method of comminuting materials which enhances comminution by providing grinding action of the materials being comminuted.

A further object of the invention is to provide a means and method of comminuting materials which urges insufficiently comminuted particles which are moving past the rotational impact zone back into the rotational impact zone for complete comminution.

A further object of the invention is to provide a blade design for the fan of the invention which provides desired air flow levels with minimum blade wear.

These and other objects, features, and advantages of the invention will become apparent with reference to the accompanying specification and claims.

DETAILED DESCRIPTION OF THE PREFERRED EMBODIMENT OF THE INVENTION

Figure 1:
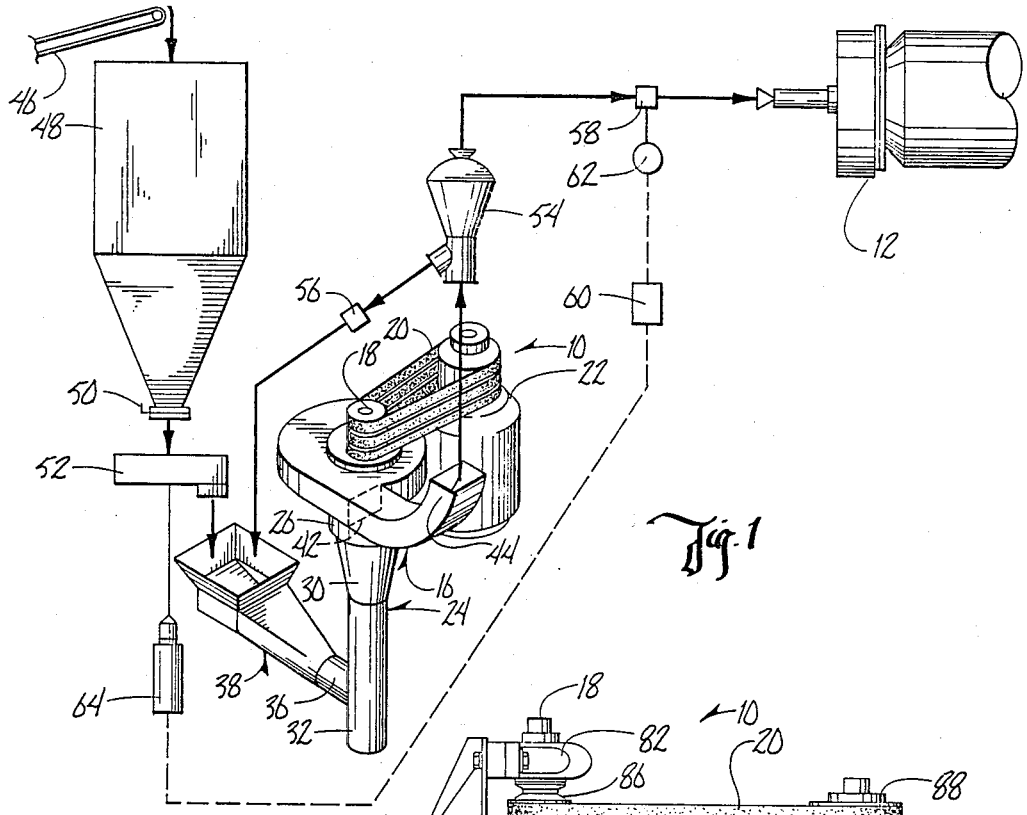
FIG. 1 is a partial elevational view, partial perspective view, and partial schematic view of the invention integrated into a micronized coal furnace system.

By referring to the drawings, the preferred embodiments of the invention are now described in detail. The invention is useful in different comminution operations, but is illustrated with micronized coal. The basic operation and method is the same for all applications, only the supporting components differ. The speed of the fan (alternatively called an impeller) and the dimension of the components, such as the cone shape of the inlet conduit, could differ as to varying applications. For example, a multi-stage device would comminute to a given particle size without external classification.

FIG. 1 depicts the comminutor 10 schematically in association with ancillary supporting components for micronizing coal and introducing it into a coal furnace 12.

The basic comminutor 10 consists of a fan 14 (see FIG. 2) contained within a housing 16. Fan 14 is rotatable within housing 16 by operative connection of axle 18 via belts 20 to a motor 22. Belts 20 and pulleys 86 allow different rotational speeds for fan 14. An input conduit 24 is comprised of an annular section 26 attached to the bottom of the housing and surrounding an inlet opening 28 (see FIG. 3), a frusto-conical section 30 and tubular section 32 having a side opening 34 therein. Side tube 36 is attached to tubular section 32 around side opening 34 and in turn, at its outer end, is put into communication with hopper 38 having a feeder gate 40.

Fan housing 16 has an outlet opening 42 along the perimetric edge of housing 16 to which is connected an outlet conduit 44.

By operating motor 22 to rotate fan 14, partial vacuum is produced in input conduit 24. By introducing the material to be comminuted into hopper 38, which controllably channels the material into tubular section 32 through side tube 36, the partial vacuum in input conduit 24 causes most of the material to be suctioned into conical section 30 where, because of the shape of conical section 30, the material is caused to assume a centrifugal, upward spiraling path. At a level immediately below the fan blade tips (the rotational impact zone), the difference in mass of the various pieces of material causes some to accelerate faster than the others, and as a result causes particle-to-particle attrition to take place. Because the centrifugal motion (angular velocity of the particles) is at a maximum in annular section 26 (the rotational impact zone), at a level nearest fan 14, the greatest amount of attrition occurs at that location, i.e., just prior to fan entry.

Attrition continues until the material is comminuted to a minute size at which point the uniform-in-size comminuted particles are suctioned into fan housing 16 and pushed by the positive air pressure on the back side of fan 14 out of outlet conduit 44 for the desired use. In FIG. 1, since the desired use consists of micronizing coal, the micronized particles are directed into the coal furnace or kiln 12. A conveyor 46 deposits lump coal into bin 48 which, by operation of gate 50 allows the lump coal to pass to disc feeder 52 which originally feeds the coal into hopper 38.

At the output end of the system of FIG. 1, a twin-cone classifier 54 is connected to outlet conduit 44 and serves to reject non-uniform size coal particles or otherwise unacceptable particles and rechannels them through air lock 56 into hopper 38. The pressure from fan 14 provides the force to move the micronized coal to classifier 54 and then to damper 58, which controls the amount of micronized coal going into furnace or kiln 12.

Control of both lump coal entering comminutor 10 and micronized coal entering furnace or kiln 12 is accomplished by coal rate controller 60 which is electronically connected to damper actuator 62 on the one hand, and a semi-conductor controlled rectifier (SCR) 64 which controls the rate of disk feeder 52 on the other hand. Coal rate controller 60 can be a computerized mechanism having sensors of rates of flow which can compare said rates to predetermined values for furnace 12 output, and, of course, can consist of manual controls. Such coal rate controllers are known in the art.

Figure 2:
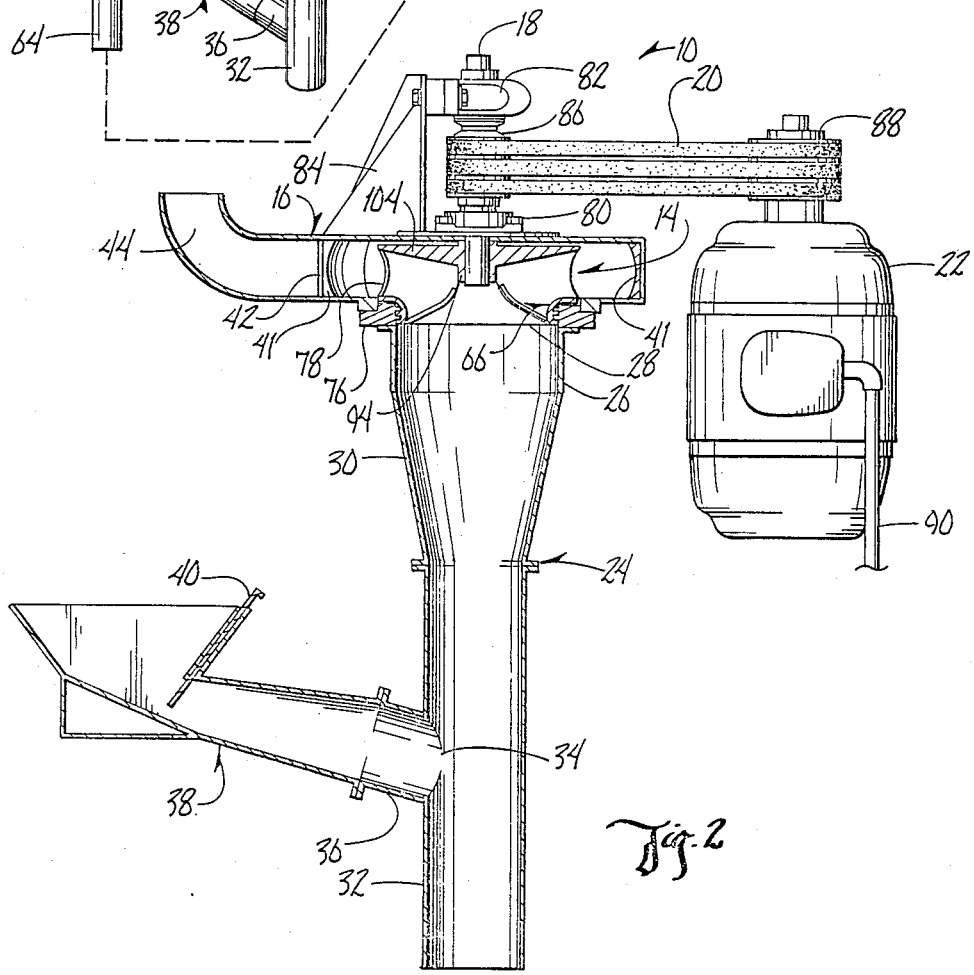
FIG. 2 is an elevational view with the fan, housing and conduits of FIG. 1 in section.

The exact structure of comminutor 10 is more clearly seen in FIG. 2. Fan 14 is removeably secured to axle 18 within housing 16. Importantly, an effective air lock is accomplished throughout the system, and particularly between input conduit 24, fan housing 16, and output conduit 44, by a ring means 66 secured annularly to the bottom of fan 14. Ring means 66 has a flange means consisting of annular rings 70 (see FIG. 4) which are mateable with flange means or rings 74 (see FIG. 4) of a journal means 76 which is secured around the inlet opening 28 on the bottom surface of housing 16. This arrangement forces all materials to pass between blades or vanes 78 of fan 14 and in conjunction with the air pressure relationships within the comminutor creates an effective air lock throughout the system. The ring and journal means also provides for retention of the bottom portion of the fan for stability and accurate positioning although a gap of approximately one-eighth inch exists therebetween. It is to be understood that the air lock gets stronger as fan speed increases because of a corresponding increase in pressure differential above and below fan 14.

Axle 18 is itself journaled within two bearings, the first bearing 80 being secured to the top surface of housing 16, the second bearing 82 extending from support 84 which in turn is attached to housing 16.

A set of pulleys 86 is rigidly secured to axle 18 between first and second bearings 80 and 82 and is frictionally rotated by belts 20 which are attachable to drive wheels 88 of electric motor 22 which is connected to an electrical power source (not shown) by electrical conduit 90.

In the preferred embodiment, journal means 76 is comprised of two semi-circular parts, both semi-circular parts being attached to housing 16 by bolts 92 (three bolts per semi-circular part). The two piece construction of journal means 76 allows journal means 76 to be removed from mating engagement with ring means 66 of fan 14 to allow removal and maintenance of fan 14. The attachment of input conduit 24 to journal means 76, and tubular section 32 to conical section 30 of input conduit 24, and hopper 38 to side tube 36 can be accomplished by methods known within the art, and usually can be accomplished by some sort of bolt means or other removable fastening means. It is to be understood that journal means 76 could also be comprised of three or more parts.

Figures 3, 4, 5, 6, 7:
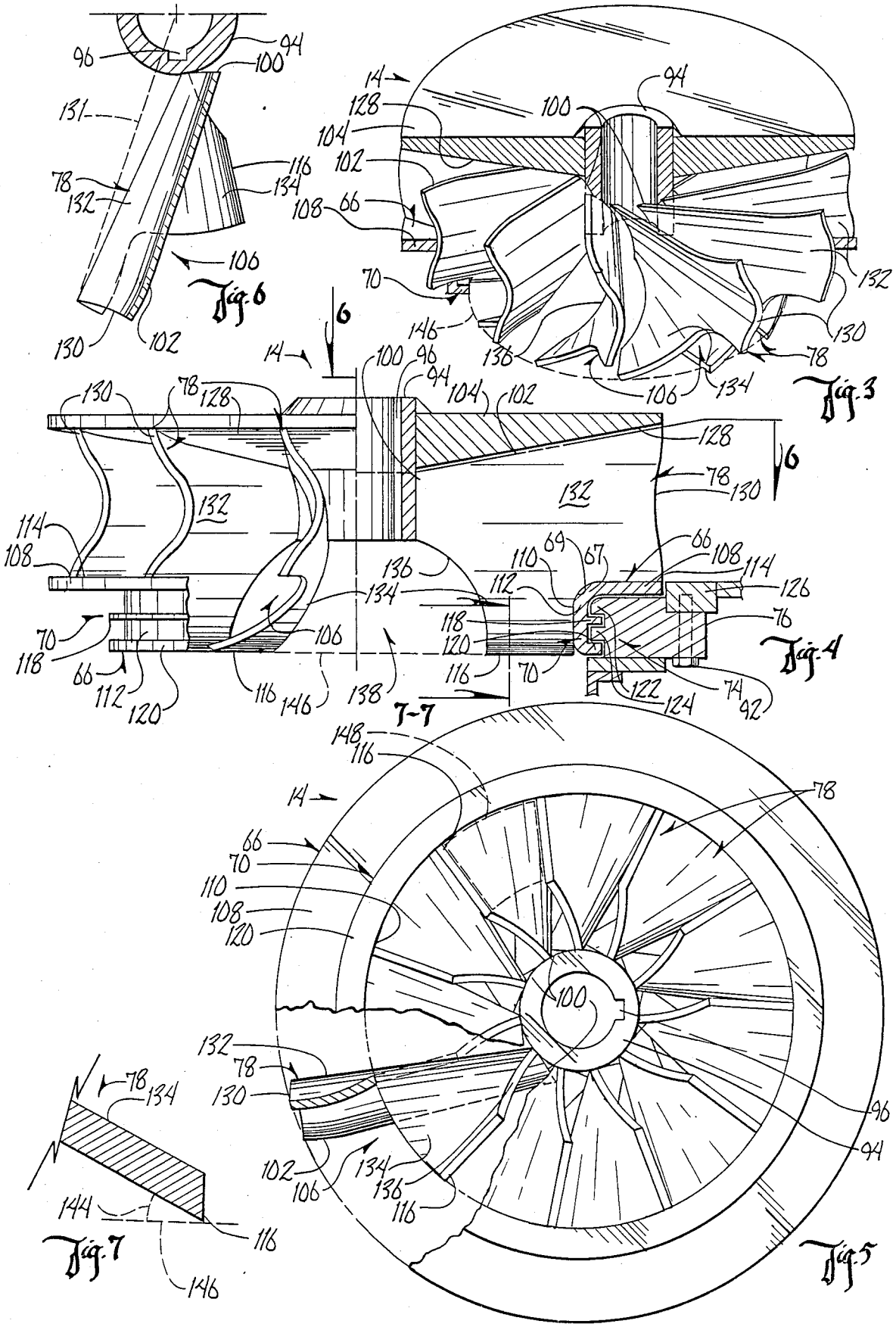
FIG. 3 is a partially exposed perspective view of the fan of FIG. 1.
FIG. 4 is a partial elevational view and partial sectional view of the fan of FIG. 3.
FIG. 5 is a bottom view of the fan of FIG. 3 with a broken away portion.
FIG. 6 is a partial sectional top view of a fan blade of the invention taken along lines 6—6 of FIG. 4.
FIG. 7 is a partial sectional view of a fan blade tip of the invention taken along lines 7—7 of FIG. 4.

By referring to FIGS. 3, 4 and 5, the exact structure and conjoint relationship of impeller or fan 14 with ring means 66 can be more clearly seen. FIG. 3 illustrates the shape and association of the preferred fan blades or vanes 78. Ring means 66 is shown as removed for clarity. The center of fan 14 is comprised of a sleeve 94 having a key slot 96 extending its longitudinal length for mateable matching of a key 98 (not shown) on axle 18. Blades 78 are attached to sleeve 94 at their innermost ends 100, and are attached at their upper edges 102 to plate 104. By referring concurrently to FIG. 4, it can be seen that ring means 66 is secured in the L-shaped cut-out portions of the lower parts of blades 78. Ring means 66 consists basically of a ring shaped member 108 secured to the horizontal edge 114 of L-shaped cut-outs 106 of blades 78, and an annular ring 112 attached to ring shaped member 108 and the vertical edge 110 of L-shaped cut-outs 106 of blades 78 extending to the lowermost edge 116 of blades 78. In the preferred embodiment, a middle ring 118 and a bottom ring 120 complete the ring means 66 described above.

Correspondingly, journal means 76 includes a top ring 122 and a middle ring 124 which matingly position between middle ring 118 and bottom ring 120 of ring means 66 to provide a journaling and retentive relationship for ring means 66 to housing 16. Journal means 76 is secured to a supporting piece 126 which is rigidly attached to housing 16 by bolts 92, and as discussed above, journal means 76 is split into two semi-circular parts (not shown) so that by removing bolts 92, journal means 76 can be split apart, thus allowing access to and maintenance capabilities to fan 14. It is worthy of mention that the farthest width of fan 14 does not extend as far as supporting piece 126, thus allowing removal of fan 14 through inlet opening 28. It can also be seen that annular section 26 of input conduit 24 can be removably attached to supporting piece 126, or can be rigidly secured thereto. The methods and manner of securement of the various components can be as is sufficient and as is known in the art.

FIGS. 3 and 4 illustrate that the lower surface 128 of plate 104 is of increasing thickness from its perimetric edge to its point of attachment with sleeve 94. Therefore, the upper edges 102 of blades 78 are correspondingly sloped eg., 10° downward. This solid back (plate 104) with an inward taper (lower surface 128) improves air flow.

It can also be seen from FIGS. 3 and 4 that the plate 104 and ring means 66 essentially sandwich and provide upper and lower boundaries and stress bearing members for fan 14, whereas blades 78 extend essentially between plate 104 and the lower edge of ring means 66.

The major portion of each blade 78, as can be seen in FIG. 4, consists of the portion extending from the points of attachment with sleeve 94 outward to outer end 130. For purposes of the description, this will be referred to as upper blade portion 132. An additional part of blade 78 extends downwardly from this upper blade portion 132 and has a lowermost edge 116 and an outermost edge (vertical edge 110) attached to annular ring 112 of ring means 66. For reference, this will be referred to as lower blade portion 134. It should be noted that the inner edge of lower blade portion 134 consists of curved edge 136 which creates a substantial open area 138 below sleeve 94 in the interior of housing 16, directly adjacent to and above inlet opening 28. However, the lowermost edges 116 of lower blade portions 134 of blades 78 extend inwardly from ring member 66 in inlet opening 28. A hard, durable material such as tungsten carbide piece 140 can optionally be secured behind and along lowermost edge 116 and curved edges 136 to create a thickened wear edge.

FIGS. 3 and 4 also illustrate the concaval shape of the forward faces of blades 78. Additional features characterized blades 78. First, the very outer portion of upper blade portion 132 of each of blades 78 is bent slightly backwards from the direction of travel. Whereas the invention operates adequately with the outer portion of upper blade portion 132 extending in alignment with the entire upper blade portion 132, it has been found that abrasion can carve a groove to be formed in the middle of the blade 78 and that bending back these outer portions prevents blade abrasion from the comminuted particles which are being conducted and pushed through fan housing 16 and out of outlet opening 42.

Secondly, ring means 66 includes a rounded shoulder 67 which mateably is positioned against rounded edge 69 of blades 78 formed between horizontal edge 114 and vertical edge 110. Rounded shoulder 69 prevents particle build-up between blades 78 and enhances air flow throughout comminutor 10.

Thirdly, the angle of lower blade portion 134 with respect to plane 146 (shown by dotted lines in FIGS. 3, 4, 7) intersecting the lowermost edges 116 of blades 78 is crucial to operation of the invention. The preferred angle (identified by reference numeral 144) between lower blade portion 134 and plane 146 is between 40° and 55°, and optimally, between 42° and 52°. In most general applications of the invention, the preferred angle 144 is 42° for twelve and twenty inch diameter fans 14 and 200, and 50° for 30 inch diameter fan 250.

In addition to the structure of blades 78, the operation of the invention is dependent upon other factors. The number and spacing of blades 78 and the speed at which fan 14 is rotated all are critical factors in the operation of comminutor 10. In the embodiment of FIGS. 1–7 (12" diameter fan 14), eleven blades 78 are utilized. Alternatively, the 20" diameter fan for FIGS. 8–13 has 16 blades, whereas the 30" diameter fan 250 of FIGS. 14–27 has 21 blades. Fans 200 and 250 will be described in detail later in the application. The spacing of blades 78 is controlled by the following ratio:

$$\frac{\text{Blade gap area}}{\text{Total inlet area}}$$

where blade gap area and total inlet area are both measured in plane 146, which is defined by lowermost edges 116 of lower blade portions 134 of blades 78, or equivalently, defined by the lowermost surface of journal means 76 or ring means 66. Blade gap area is thus the area between each 78 as shown by the dotted line 148 in FIG. 5. It is preferred that the ratio be between 1:20 and 1:25.

The speed of fan 14 is variable, but for a desired particle size can be determined by utilizing fan laws, such as are known in the art. Fan 14 is generally rotated at a tip speed of from 300 to 500 feet/second. Motor 22 generally must produce a rotation of axle 18 of from 5,000 to ~~8,000~~ r.p.m. for the embodiment in FIGS. 1–7. Fan 14 is 12 inches in diameter, has 11 blades each being 2¾ inches tall, and is generally rotated at 7250 r.p.m. resulting in the lowermost edges 116 traveling at 269 feet per second. The air volume of fan 14 would be approximately 1000 a.c.f.m. (average cubic feet/minute). On the other hand, a 20 inch fan with a blade height of 1¾ inches and having 16 blades run at 4000 r.p.m. producing a tip speed of 279 feet per second would product approximately the same air volume. The r.p.m. of the fan is a function of its size. The tip speed of the fan is the most important factor, not its r.p.m. Refer to Chart 1 below for exact specifications of input and output pressures, feed rates and horsepower for various sized fans.

CHART 1

| FAN SIZE | SUCTION PRESSURE | DISCHARGE PRESSURE | COAL FEED RATE | TOTAL FEED RATE | HORSE POWER |
|---|---|---|---|---|---|
| 20" Loaded | −25" WG | +15" WG | 83 lb/min | 233 lb/min | 75 |
| 20" Unloaded | −30" WG | +10" WG | | 150 lb/min | 30 |
| 30" Loaded | −45" WG | +20" WG | 167 lb/min | 444 lb/min | 150 |
| 30" Unloaded | −50" WG | +15" WG | | 278 lb/min | 70 |

It is to be understood that the combintion of the angle of incidence, the number and the spacing of blades 78, combined with the tip speed of lowermost edges 116, assists in producing the action which results in the efficient and uniform comminution of comminutor 10. This combination, it is believed, produces a wave-like action in the rotational impact zone in the interior of annular section 26 directly below lowermost edges 116. A wave-like air pressure effect is created tending to sequentially push and rotate the material being comminuted, thereby maintaining the material in the rotational inpact zone for a longer period of time for particle-to-particle attrition to take place.

While the combination of ring means 66 and journal means 76 creates an enhanced air lock and air flow through the device, the angle of lowermost edges 116 along with lower blade portions 134, and the spacing and number of blades 78 is primarily responsible for the wave-like action.

FIGS. 5 and 6 show clearly how the inner edge 100 of each blade 78 is attached to sleeve 94 at a location along sleeve 94 which is forward from an imaginery line drawn between the center of sleeve 94 and the rearward most part of outer edge 130 of blade 78 (see, e.g., dashed line 131 in FIG. 6). Therefore, outer edge 130 trails inner end 100 for each blade 78 making each blade 78 "swept back". FIG. 5 also shows how upper blade portions 132 of blades 78 extend inside housing 14 past the inlet opening 28 defined by journal means 76.

The operation of the comminutor 10 is as generally described previously. In the case of the apparatus shown in FIG. 1, lump coal from bin 48 is, in a controlled manner, introduced into input conduit 24. It is to be noted that unwanted material such as pig or tramp iron or metal chicks are immediately disposed of out of the open bottom of tubular section 32. The suction of fan 14 pulls most of the material to be comminuted into input conduit 24. The material slows down and assumes a centrifugal motion at the larger inside diameter frustoconical section 30. The material reaches a maximum velocity as it is pulled into annular section 26 directly below fan 14 and it is held there by the force generated, as explained by fan laws. The material is then comminuted to a reduced size between 0 and ¼ inch depending on the pressure being produced (which is negative in front of the fan). When it has been reduced to the minimum size for the corresponding pressure, the material will be light enough that it rises into the fan where it is then sent out of the outlet opening 42 into classifier 54, wherein the material is sorted, either to be re-introduced into the comminuter or channeled directly into the kiln 12.

It is to be noted that blades 78 extend downwardly to just above the bottom of journal means 76. All or a portion of annular section 26 of input conduit 24 comprises what shall be known as the rotational impact area or zone (or RIZ) It is at this area where tee smaller particles of the material actually assist in breaking up the larger particles. Therefore, the materials are held at this location until a uniform-in-size particle is created, at which time it is lifted into the fan housing and then moved out by the positive pressure of the back side of the fan.

Figure 8:
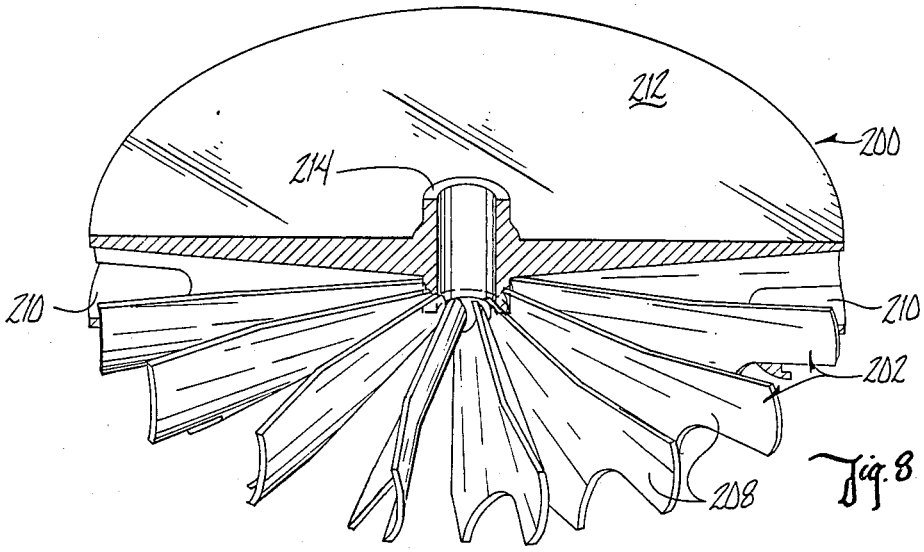
FIG. 8 is a partially exposed perspective view of an alternative embodiment of a fan according to the invention.
Figure 9:
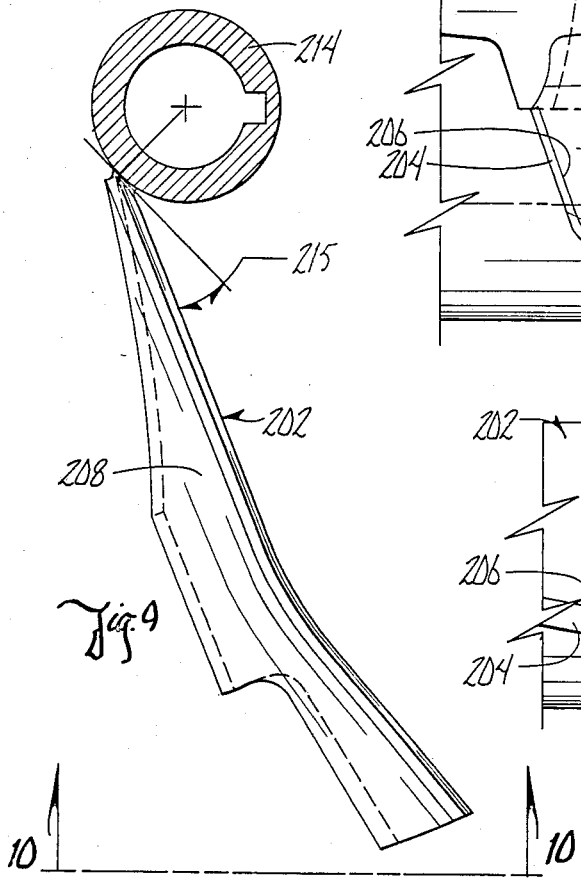
FIG. 9 is an isolated bottom view of one fan blade of the embodiment of FIG. 8.

Further alternative embodiments of the invention are possible which achieve the objects of the invention or further improve its results. By referring first to FIGS. 8–13, an alternative embodiment of the impeller or fan is shown. This alternative embodiment of the fan shall be referred to as fan 200. Fan 200 differs from fan 14 of FIG. 2–7 in the following respects. First, the number of individual blades 202 of fan 200 has been increased from 11 to 16. Secondly, blades 202 are flatter along their longitudinal axes and lower most edges than blades 78 of fan 14, which have bent back edges. Blades 202 are only slightly bent back as can be seen in FIGS. 8, 9, and 12. Again optionally, a replaceable rigid and durable piece 204 can be secured along the entire lower edge 206 of each blade 202 (see FIG. 10). The preferred material for piece 204 is a carbide material (e.g., tungsten carbide). Likewise, a rigid durable liner 207 made of material such as carbide can be attached to the whole face 208 of each blade 202, and a similar coating 209 can be applied around all exposed inner surfaces of ring member 210 (see FIG. 11) which functions to create an airlock like ring member 66 as described with respect to FIG. 4 above. It is also to be understood that the carbide or similar material could also be secured to the inside surfaces of fan housing 16 if desired.

Figure 10:
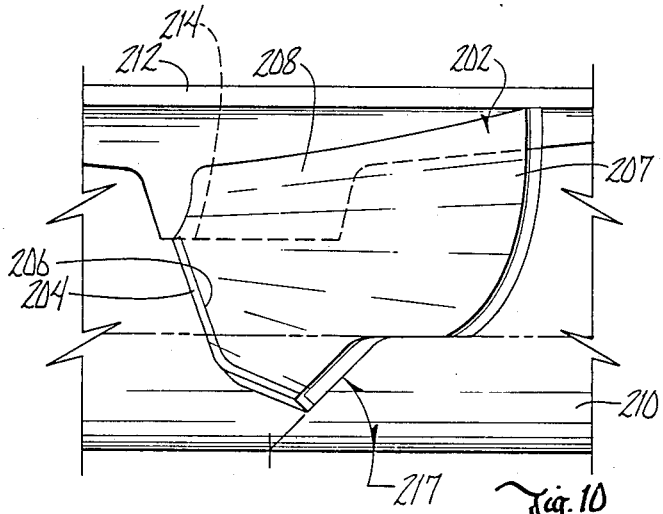
FIG. 10 is a partial elevational view taken along lines 10—10 of FIG. 9.

FIGS. 8 and 9 show this alternative embodiment of fan design, including its orientation with top plate 212 (the same as plate 104 of FIG. 3), and a similar swept-back angle 215 (approximately 22½°) of each blade from the axle and axle sleeve 214 (as shown in FIG. 9). FIG. 10 gives a better view of the sweep of each fan blade 202 and its angle of attack, (in the preferred embodiment 42° shown by reference numeral 217) being substantially similar to that discussed with respect to FIGS. 1–7. FIG. 10 also shows the optional carbide wear edge piece 204 extending the length of the blade 202, and the carbide surface 207 of blade 202.

Figure 11:
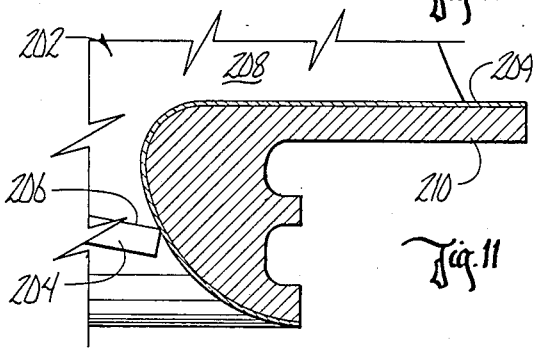
FIG. 11 is a partial sectional view of the ring and flanges for the embodiment of the fan shown in FIG. 8.
Figure 12:
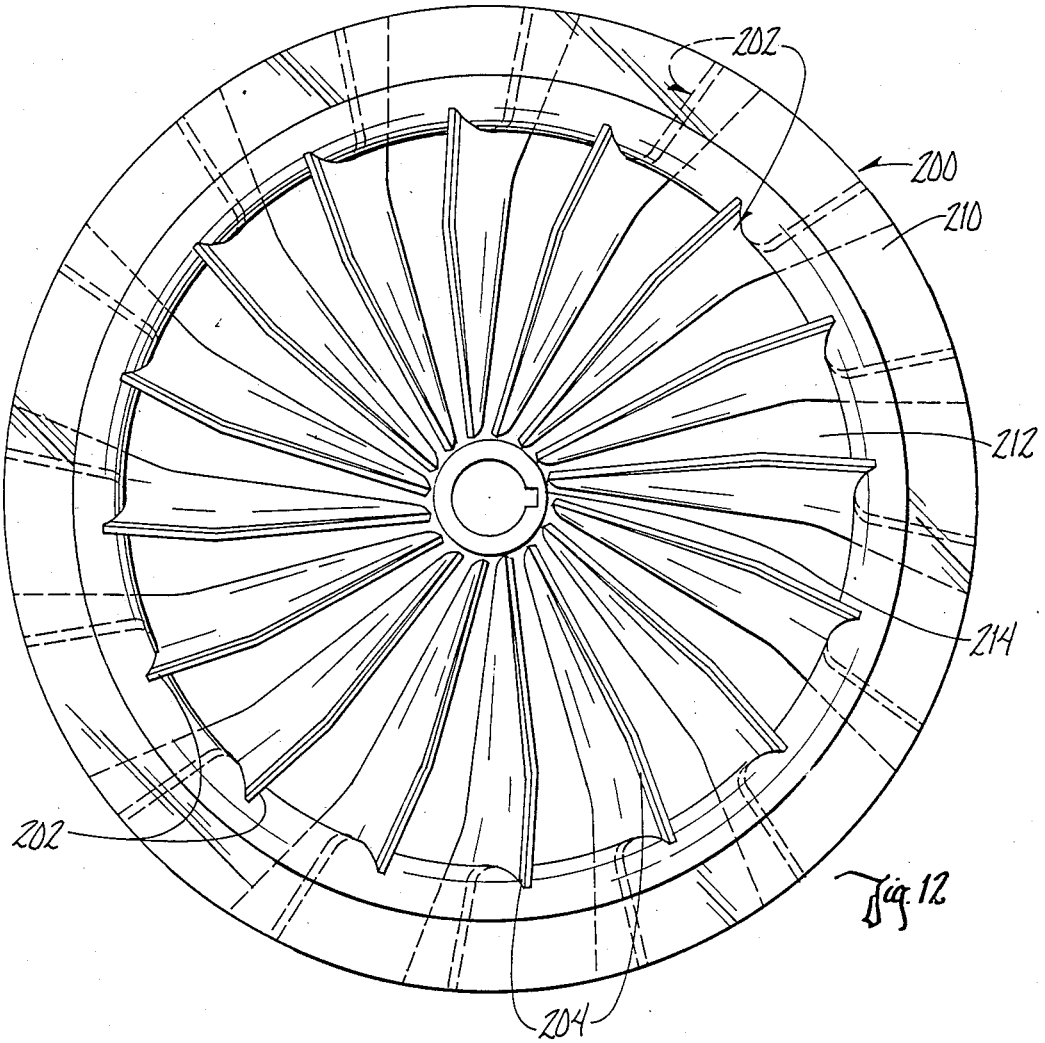
FIG. 12 is a bottom plan view of the fan embodiment of FIG. 8 within its housing.

FIG. 11 depicts the carbide coating 209 of ring member 210 and the more rounded surface of that part. The rounded inner-facing surfaces of ring member 210 further prevent build-up of particles at that location and the carbide coating 209 reduces wear.

FIG. 12, a bottom view of fan 200 within housing 12, is similar to FIG. 5. It is to be understood that the total area between blades 202 conforms to the total inlet area according to the formula set forth previously.

Figure 13:
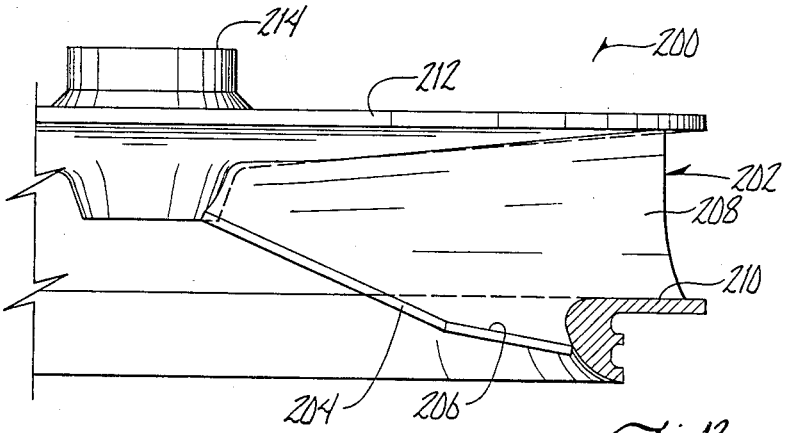
FIG. 13 is a partial elevational and partial sectional view of the embodiment of the fan shown in FIG. 12.

FIG. 13 is similar to the right hand portion of FIG. 4 and shows the overall structure of fan 200 including ring member 210.

The improvements of the alternative fan design of FIGS. 8–13 are summarized as follows. The aggregate, during comminution, is flying around in front of (that is, directly below), the lowermost edges 206 (and, if used, wear edges 204) of fan 200 which has a fan blade tip speed of around 300 feet per second. A vortex of aggregate is formed because of the air flow pulling the aggregate vertically upward towards fan 200, and concurrently the centrifugal spiraling air flow caused by the conical part of the input conduit 24. Bands of aggregate are formed in the vortex within input conduit 24, the fastest of these bands (in terms of angular velocity), consists of the smallest particles and is directly below the bottom edges 206 of fan 200. When the aggregate particles reach a small enough size, they are pulled inward by the air flow towards the cavity of the vortex at a point nearest fan 200 and along this pathway strike wear edge pieces 204 and/or lower edges 206 of blades 202. Thus, the particle-to-particle attrition at the outside of the fastest and uppermost bands creates most of the comminution, including instances of larger particles randomly and accidentally entering the top bands. Centrifugal force keeps the vast majority of the larger particles in the lower bands of movement until they become small enough for the air flow to carry them to the top bands. When these particles become comminuted to the desired size, the air flow then overcomes centrifugal force and pulls them into the center of fan 200 and they are then conveyed out of the outlet of the fan housing.

Carbide surfacing liner 207 of the surfaces of blades 202 and inside of housing 16 will further serve to prevent abrasion to the particles as they fly across the blades and onto the inside of the housing and reduce wear in those parts.

While various products could be used to function as wear edges 204 of blades 202 and as liners 207 for blade surfaces, coating 209 for ring member 210 and housing inner surfaces, tungsten carbide is the preferred substance. The tungsten carbide can be applied either as tiles or as a baked-on surface.

Other preferred specifications of this embodiment are as follows. Fan 200 is 20 inches in diameter, as compared to the 12 inch diameter of the first described embodiment. Fan 200 is operated at a preferred speed of 5,500 r.p.m., (previously 7,250 r.p.m.), with a tip speed of 397 feet per second (previously 269 feet per second). All other factors such as blade angle and thickness are the same.

Figures 14, 15, 16:
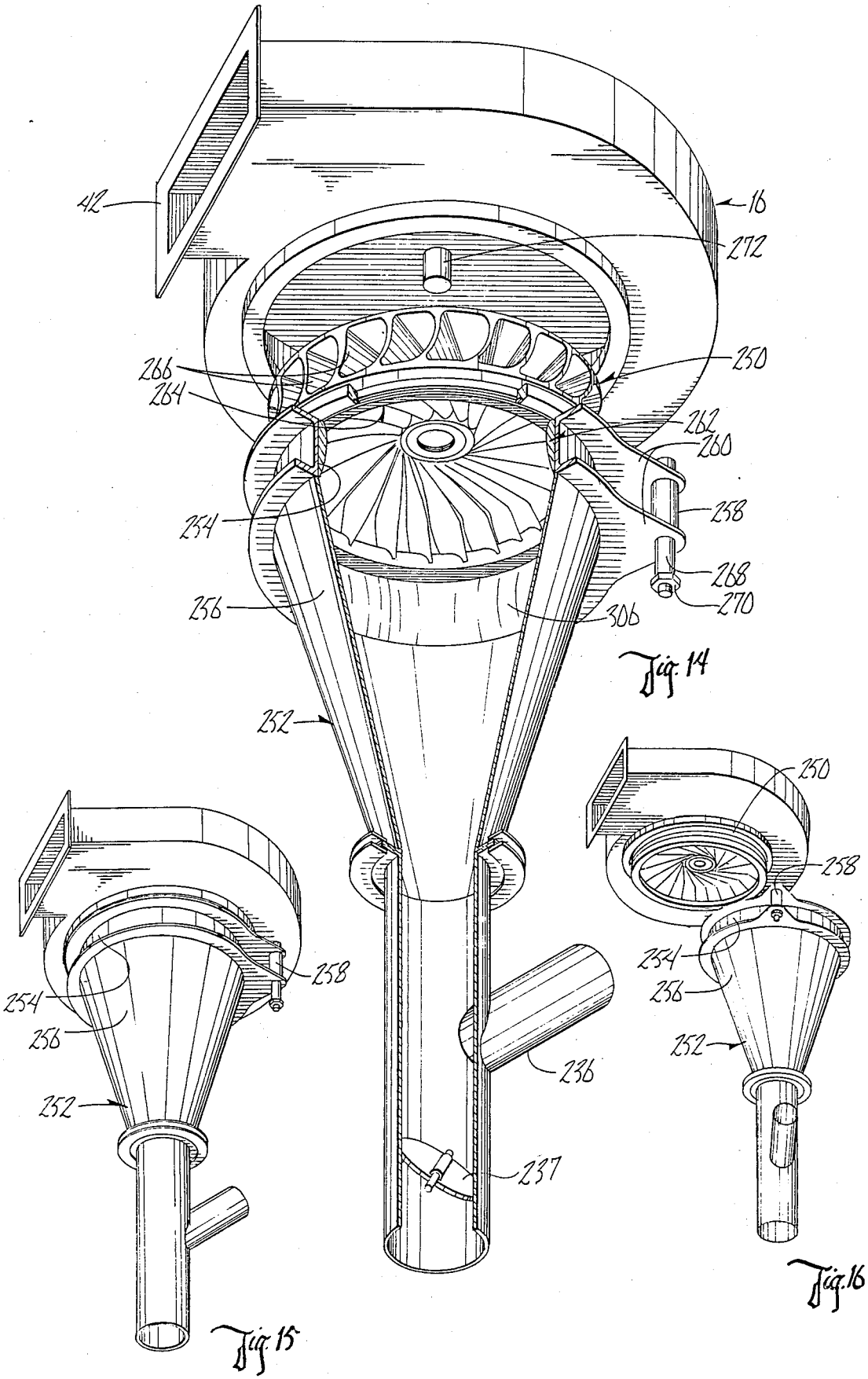
FIG. 14 is a perspective view of an alternative embodiment of the invention with the interior of the inlet conduit exposed, and the fan and fan housing shown in exploded form.
FIG. 15 is a perspective view of the embodiment of the invention in FIG. 14 shown in assembled form.
FIG. 16 is a perspective view of the embodiment of the invention shown in FIGS. 14 and 15 showing how the inlet conduit can be pivoted, away on the housing to allow the inspection and removal of the fan.

FIGS. 14–27 depict still another general alternative embodiment of the invention, including various specific alternatives. Referring specifically to FIG. 14, it can be seen that the general configuration of this alternative embodiment of the pneumatic comminutor according to the invention is the same as those embodiments previously described. The differences generally are, first, fan 250 is entirely a one piece cast component for better structural integrity and cheaper manufacture. Fan 250 retains the same characteristics of the fan embodiments previously described. Secondly, input conduit 252 is slightly modified to reduce the size of the annular portion 254 (corresponding to annular portion 26 of FIG. 2). Thus, conical portion 256 of input conduit 252 is longer and larger and extends much closer to fan 250.

Thirdly, as can be seen in FIG. 14, a pivoting mechanism comprised of a pivot pin 258, and a pivot bracket 260 is secured to the upper portion of input conduit 252 and pivot pin 258 is pivotally secured to housing 16 to allow the entire input conduit 252 to swing or pivot with respect to housing 16 to allow easy access to fan 250.

Fourth, a liner 262 has been added to the inside of input conduit 252 which generally corresponds to what is the rotational impact zone.

Fifth, an alternative air lock system 264 is utilized as will be subsequently discussed specifically.

It is to be understood that in the preferred embodiment shown in FIGS. 14–27, the impeller or fan is further increased to 30 inches in diameter (fan diameters reflect widest outside diameter) and now includes twenty-one blades 266.

FIGS. 15 and 16 depict the manner in which input conduit 252 can be pivoted with respect to housing 16. In FIG. 15, input conduit 252 is secured to housing 16 in operating position. It is pointed out that pivot pin 258 has an extended portion 268 in that position. By referring to FIG. 16, it can be seen that input conduit 252 must first be unfastened from housing 16 (by means known in the art), slid downwardly on pivot pin 258 until pivot bracket 260 hits stop member 270 at the end of extended portion 268 of pivot pin 258. Then sufficient clearance exists to swing input conduit 252 away to expose access to fan 250. This feature makes it easy and convenient to inspect fan 250, the housing 16, and to remove, perform maintenance on, or replace fan 250.

Figure 17:
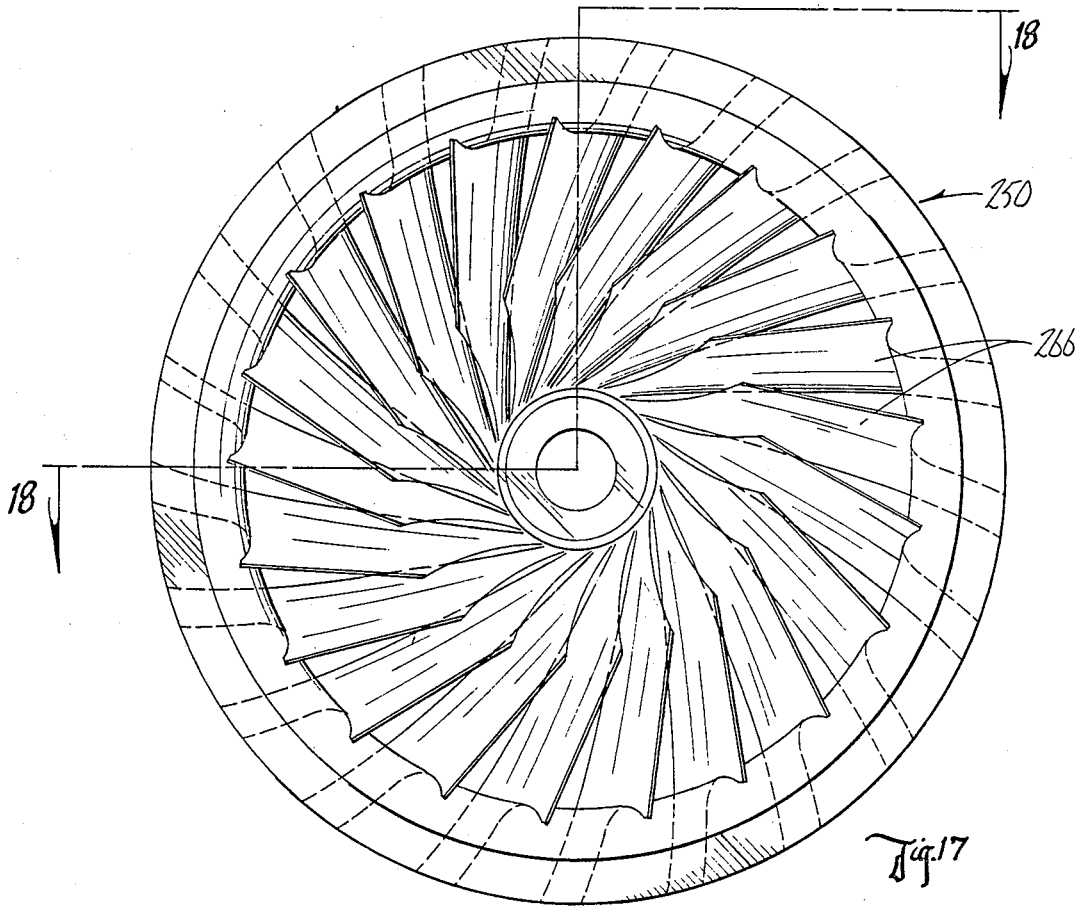
FIG. 17 is a bottom plan view of the embodiment of the fan shown in FIG. 14.

FIG. 17, similar to FIGS. 12 and 5, shows a bottom view of fan 250 and its 21 blades. Each blade 266 can have an optional wear edge (which can be tungsten carbide as explained previously). Again, fan 250 conforms to the formulas previously discussed to produce the desired air flow. All basic characteristics of fan 250 follow the same principles and specifications discussed with respect to other embodiments of the fan for the invention.

Figure 18:
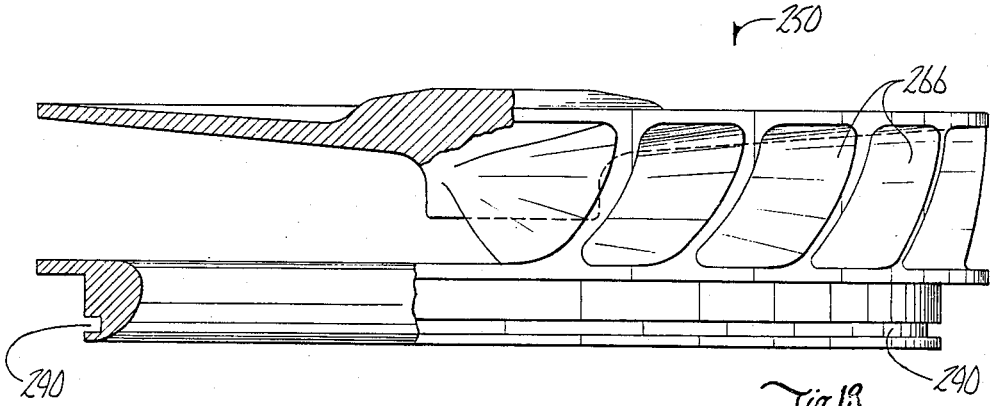
FIG. 18 is a partial sectional and side elevational view taken along lines 18—18 of FIG. 17.

FIG. 18 depicts the unitary structure of cast fan 250. Fan 250 contains the same features and structures as discussed with the previous embodiments of fans for the invention.

Figure 19:
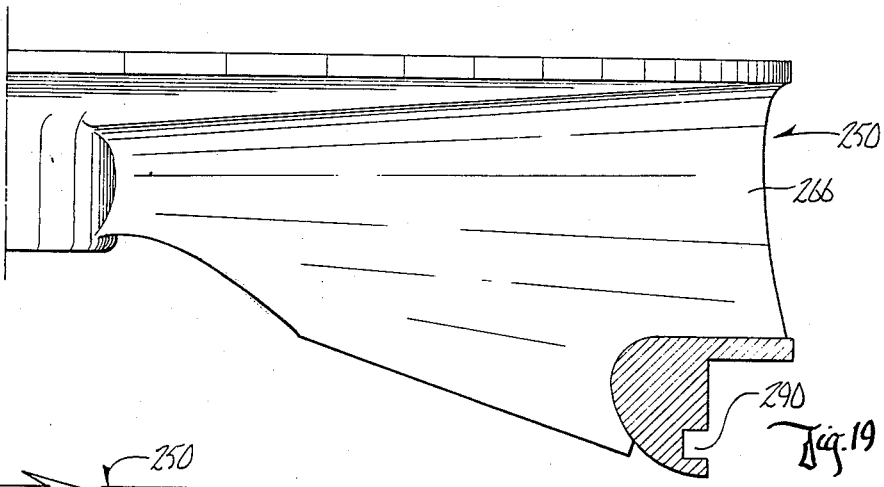
FIG. 19 is a partial side elevational view and partial sectional view of an embodiment of the fan shown in FIG. 14.

Likewise, similar to FIGS. 4 and 13, FIG. 19 shows a single blade 266 for fan 250.

Figure 20:
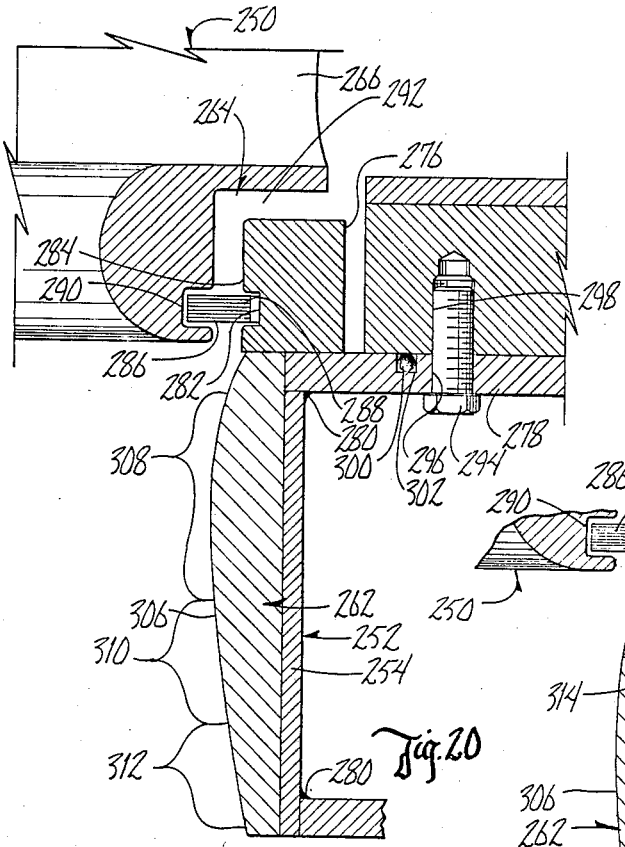
FIG. 20 is a sectional view of the curved or sloping rotational impact zone liner and the air lock of the alternative embodiment of the invention shown in FIG. 14.

FIG. 20 shows in detail the alternative embodiment for producing an air lock between input conduit 252, housing 16, and fan 250. An annular support 276 is secured by means known within the art to horizontal plate 278 of input conduit 252, which is secured by welds 280 or other conventional means. Annular support 276 includes a groove or channel 282 which runs around its entire inside facing surface 284. A brush ring 286 is secured in a corresponding channel 282 by a securing member 288, such as is known in the art. Brush ring 286 extends radially inwardly into corresponding channel or groove 290 of fan 250 to block gap 292 between fan 250 and annular support 276.

Brush ring 286 preferably is made of steel bristles and can wipingly abut channel 290 of fan 250 for an optimum air lock. Alternatively, brush ring 286 can be made of other materials such as is obvious to those skilled in the art. It is to be understood that the deflectable nature of brush ring 286 allows fan 250 to be separated from mating engagement with brush ring 286 without damage to any components. Annular support 276 and fan 250 are about ¾" apart. This eliminates the need to dismantle annular support 276 every time fan 250 needs to be removed. Brush ring 286 can either be mechanically fastened to annular support 276, or alternatively, be epoxied in place. Because of its somewhat flexible nature, contact of brush ring 286 to fan 250 will not cause detrimental friction or wear and in fact will enhance the air lock. Alternative materials for brush rings 286 can be Teflon®, nylon, or plastic. It is to be understood that alternatively two or more brush rings and corresponding grooves or channels in fan 250 could be utilized, if desired.

FIG. 20 also shows the simplified manner in which input conduit 252 is secured to fan housing 16 during operation. Bolts 294 simply are fastened through apertures 296 in horizontal plate 278 and into threaded bores 298 in housing 16. An annular sealing gasket ring 300 can be positioned within a channel 302 to further insure against air leaks from the system. Thus, as previously discussed, to swivel input conduit away from housing 16 requires only the removal of bolts 294 and then the downward dropping of input conduit 252 so that brush ring 286 is removed from channel 290 in fan 250, and then input conduit 252 is clear to swivel away.

FIG. 20 also shows a still further alternative and advantageous component. The rotational impact zone liner member 262 is secured to the inside of input conduit 252 at its uppermost end (annular portion 254), namely, in the rotational impact zone previously discussed. Liner 262 can . serve different purposes. First, liner 262 is preferred to be made of an abrasive substance to enhance comminution by imparting grinding action to those particles which contact it. As previously discussed, the rotational impact zone involves various layers of different massed particles flowing with the angular velocity caused by the centrifugal forces against the inside of input conduit 252. In the preferred embodiment, liner 262 is made from white iron containing 25% to 28% chrome iron to produce this abrasive quality. Liner member 262 can be attached to input conduit 252 by any manner known within the art, preferably in sections (see FIG. 23) by bolts (not shown).

Still further, FIG. 20 also shows that liner member 262 is convexoplanar in cross-section, having a curved inner surface 306. Both the top portion 308 and bottom portion 312 of inner surface 306 slope away from and narrow as compared to middle section 310 of inner surface 306. This presents the somewhat rounded shape of inner surface 306 of liner 262. Different velocity gradients exist for different bands of particles in the rotational impact zone. Along inner surface 306 of liner 262 the upper layers of particles along portions 308 and 310 of inner surface 306 in the rotational impact zone (those being nearest fan 250) are moving the fastest, as their size and mass is the smallest. However, from time to time there are particles which are as of yet insufficiently comminuted (still oversized) and which inadvertently enter these top levels from along lower portion 312 or elsewhere. They will more than likely strike or be pushed against the sloping, rounded inner surface 306 of liner member 262. The downward sloping bottom portion 312 of inner surface 306 assists in causing these insufficiently comminuted particles to be reflected, migrate, or travel down along sloping surface 306 and back down into a level in the rotational impact zone where they should be and where further and complete comminution can take place. Downward sloping portion 312 of inner surface 306 provides a reflection surface for as yet over-sized particles. The angle of incidence causes those particles to travel back into the lower bands or velocity gradients in the rotational impact zone to adequately complete desired comminution.

Figure 21:
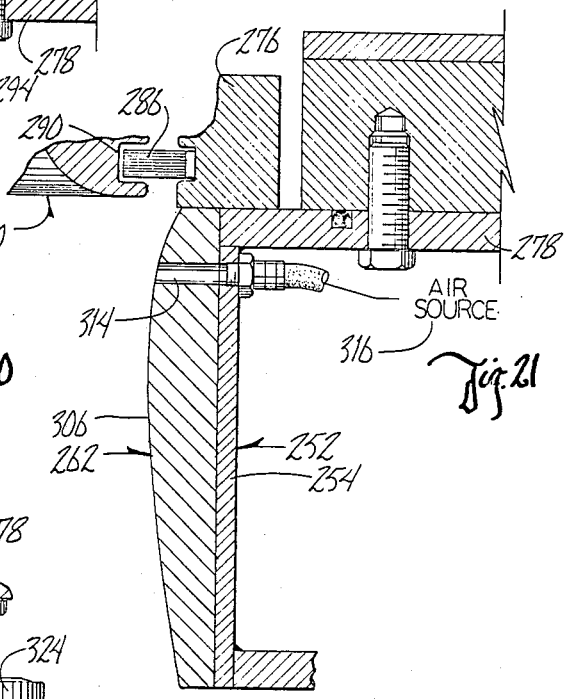
FIG. 21 is a sectional view of the alternative embodiment of the invention shown in FIG. 14 showing a representative pressurized air jet directed tangentially into the rotational impact zone.

FIG. 21 (in conjunction with FIG. 23) depicts a still further alternative to aid in improving comminution. A plurality of channels 314 through liner member 262 and input conduit 252 could be connected via means known in the art to a pressurized air source 316. Channels 314 would therefore be in fluid communication with the rotational impact zone at a point near the upper level of the same. By causing the pressurized air to be directed tangentially and radially inwardly (see FIG. 23), more speed or angular velocity is imparted to the particles. This, by increased centrifugal force, holds the particles in the rotational impact zone for a longer time, giving those particles a chance to be comminuted to a smaller size before being over come by the air flow through the fan to the outlet.

Figure 22:
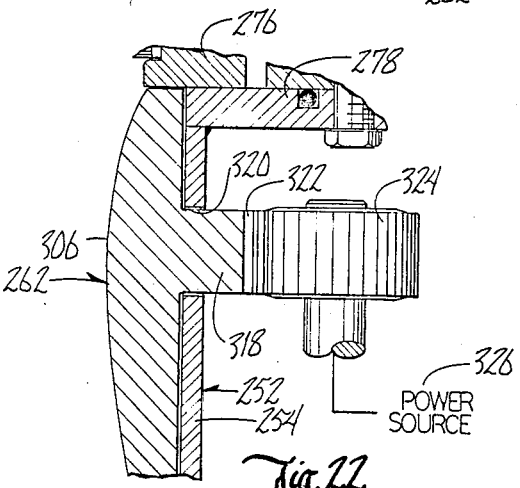
FIG. 22 is a sectional view showing an alternative feature of the invention involving a rotational impact zone liner which is rotatable in a direction counter to the air and particle flow in the comminutor.

FIG. 22 shows a still further alternative embodiment for utilization with respect to liner member 262. Liner member 262 could be isolated from input conduit 252 and could have an annular flange 318 extending through a slot 320 in input conduit 252 which by virtue of gear teeth 322 could be operably mated with gear teeth 324 of a rotating power source such as motor 326. By operating motor 326 appropritely, liner member 262 could be rotated, in the preferred embodiment, in a direction opposite to that of the spiraling angular velocity flow of the air and vortex of particles within input conduit 252.

Such counter-revolution of liner member 262 would further enhance grinding action for improved comminution.

Figure 23:
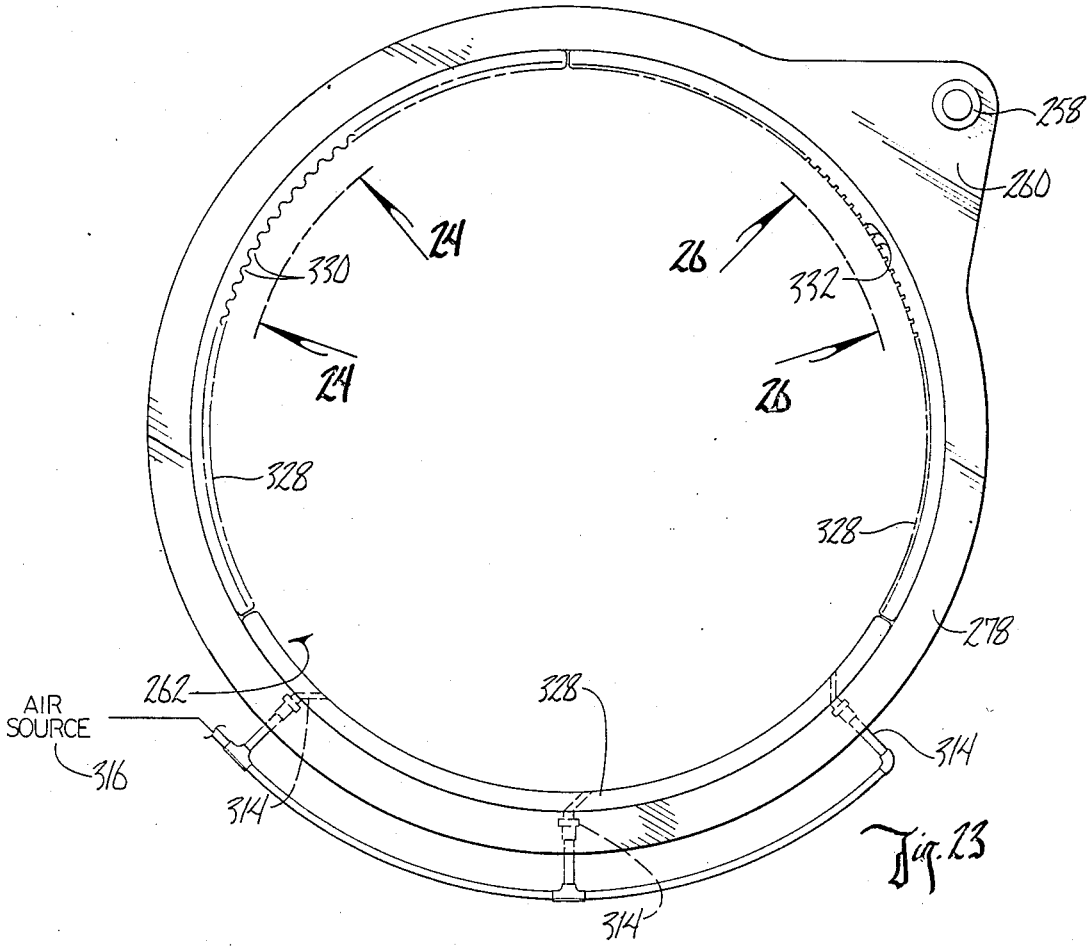
FIG. 23 is a plan view of the top of the pivoting inlet conduit including the rotational impact zone liner according to the alternative embodiment of FIG. 14 further showing alternative embodiments for uneven surfaces of the liner and the tangential air jets.
Figure 24:
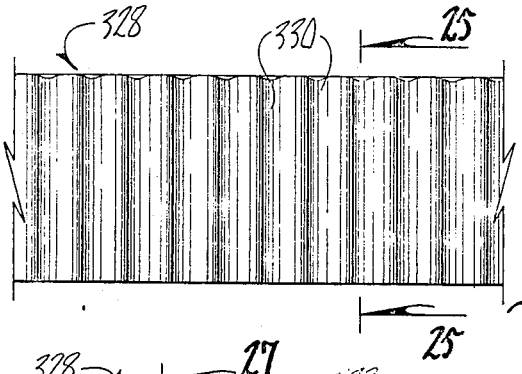
FIG. 24 is a partial elevational view taken along lines 24—24 of FIG. 23.
Figure 25:
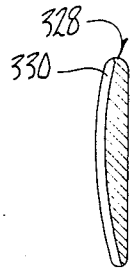
FIG. 25 is a sectional view taken along lines 25—25 of FIG. 24.
Figure 26:
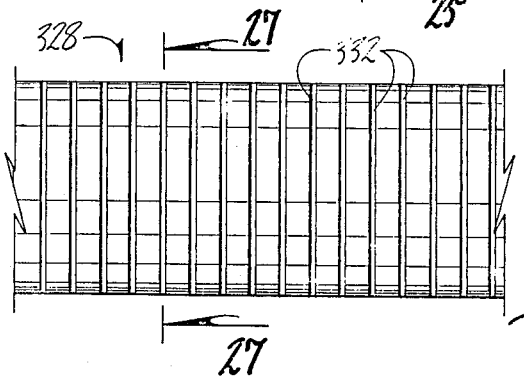
FIG. 26 is a partial elevational view taken along lines 26—26 of FIG. 23.
Figure 27:
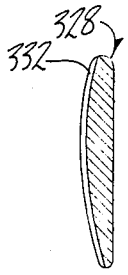
FIG. 27 is a sectional view taken along lines 27—27 of FIG. 26.

FIGS. 23–27 depict another alternative embodiment for improved comminution. FIG. 23 shows a top view of pivot bracket 260 and liner member 262 disposed therein. It should be noted that liner member 262 can be constructed of a plurality of segments 328 to aid in manufacture, installation, maintenance and replacement. Segments 328 of liner member 262 can be secured to input conduit 252 by means known within the art (preferrably bolts, not shown).

FIG. 23 also shows that to further enhance the grinding action of liner member 262, an uneven surface can be machined, cast, or otherwise manufactured into the inner surface 306 of liner member 262 to produce the same. Two alternatives are depicted. To the left in FIG. 23, and in FIGS. 24 and 25, concave shaped grooves 330 are shown. Alternatively, to the right of FIG. 23, and in FIGS. 26 and 27, channels 332 are shown. In both instances, grooves 330 or channels 332 are disposed transversely of the general plane of liner member 262 so that the grinding action of the uneven surfaces of grooves 330 and channels 332 will be particularly effective to the particles which will pass generally horizontally across their surfaces. Grooves 330 or channels 332 have been found to also increase the speed of the particles. Optional tangential air jets 314 are also depicted.

General operation of the invention has been previously described. However, increased understanding of the process of comminution reveals the likely nature f the comminuting action which occurs within the device. This understanding has led to the further improvements and refinements of the invention over that in co-pending Ser. No. 697,042. While not wishing to be bound by theory of operation, the following are believed significant considerations.

First, the pneumatic operation of the invention provides the unique ability of the comminutor, according to the invention, to intrinsically provide the energy for conveyance, comminution and classification of the material being comminuted. Secondly, the efficiency of the entire comminution process is greatly improved because of the above factor and the significant amount of control it allows. Thirdly, the present invention allows much more uniform-in-size final product at a much smaller size with the additional feature of removing the sufficiently comminuted particles to output to avoid the danger of over-grinding.

The comminution process can perhaps best be described with reference to FIG. 14. The material to be comminuted (pre-sorted in this embodiment to be less than five centimeters wide) is fed through side tube 236 (6 inches in diameter) into input conduit 252. The high speed operation of fan 250 produces a suction of 3,000 to 6,000 cubic feet per minute of air (a.c.f.m.) which enters through the bottom of input conduit 252 (6 inches in diameter). Technically, this lower end of input conduit 252 serves as a mass specific fluidized bed which rejects input material that is too massive by simply allowing it to fall out the bottom. Damper 237 is adjustable to alter the air input characteristics of the system.

The input material is basically suctioned straight up input conduit 252 until it reaches the lower part of conical section 256. At this point, a vortex has formed from fan 250 and the vertical velocity of the material decreases while the angular velocity increases as the conical section 256 expands in diameter. The spiraling, slowly upward moving material begins particle-to-particle attrition as the particles accelerate through velocity gradients upwardly towards the rotational impact zone bounded by liner 262 in annular portion 254 above the top of conical section 256 and just below fan 250. In this spiraling journey, the material travels at once towards the walls of input conduit 252 and then upward as the particles become small enough to be suspended. Angular and vertical velocities vary greatly within the system and a particle that was accelerated out ward will tend to fall as it approaches the wall of input conduit 252 where vertical velocities are lower. Particles undergo multiple collisions while traveling in any one direction so that progress in that direction is the average of many path lengths. Therefore, at this point in the operation, the material is spiraling around the conical section 256, gradually increasing its angular velocity while gradually decreasing its vertical velocity upwardly. This action allows the differing mass particles (therefore traveling at different speeds) to crash into one another to achieve particle-to-particle attrition. Also, the "breaking-apart" particles from time to time bounce around and travel into the walls of input conduit 252.

Once the particles have reached a small enough size, the vertical components of air flow will overcome the angular velocity components to force the particles to the upper portion of input conduit 252, the rotational impact zone surrounded by liner 262. The highest angular velocity is in the rotational impact zone just below fan 250. Radial acceleration is the greatest at this point since velocities almost equal that of fan 250. However, the large angular velocities (100 to 300 feet per second) practically prevent particles from reaching fan 250 so that a relatively particle-free region exists for about three centimeters below fan 250. Particles experience the most violent grinding in this region and produce the largest concentration of small particles. Particles small enough to be entrained by the vertical velocity may reach fan 250 at any radial point, in spite of the radial acceleration. The majority of the particles reach fan 250 nearer the center after traveling along the walls of the rotational impact zone for some distance, however short, then being brought back to the center by eddies and vertical currents. It is to be understood that the preferred alternative embodiments utilize an abrasive rotational impact zone liner. It has been found that the high angular velocities in the rotational impact zone force many particles against the walls of inlet conduit 252, thereby presenting the opportunity to increase comminution by grinding the spiraling particles against the abrasive liner. The above understanding also allows the development of the sloped liner 262 which compels insufficiently comminuted particles to be reflected or to travel down the sloped surface 306 back into the intense comminution level of the rotational impact zone. The same considerations resulted in development of the uneven and irregular surfaces of the liner (FIGS. 23–27), counter-revolution of the liner (FIG. 22), and the introduction of tangential pressurized air jets into the rotational impact zone (FIG. 21).

The conveyance of the sufficiently comminuted particles to output by the invention via its pneumatics produces the further advantages of allowing the materials to be dried by the air and also allows a recycling of the product utilizing appropriate secondary conveyance means.

Wear on the components of the present invention is minimal. The extremely fine size of the particles possible are exemplified by coal, which can be ground to sub-10 micrometer sizes. This is approaching grain size which means that impurities exist as separate particles, therefore allowing their easy removal by magnetic or other physical means. Also, the fine size of the particles allow a product that burns essentially like oil spray. Also, the ability to closely control particle size reduces or eliminates any required finish grinding.

The included preferred embodiment is given by way of example only, and not by way of limitation to the invention, which is solely described by the claims herein. Variations obvious to one skilled in the art will be included within the invention defined by the claims. It can be seen that the invention achieves at least all of its stated objectives.

It is to be understood that the interior of the fan housing could include a ceramic lining or the blades of any of the fan embodiments could be coated with a material such as, for example, ceramic tiles, a tungsten carbide sheet, or a rubber lining to reduce wear. A window could be added to the input conduit for viewing of the comminution and for access to the interior of the input conduit.

It is to be understood that dynamics of the rotational impact zone and the comminutor can be changed by altering the fan blade angle and the blade spacing or gap area to inlet area ratio. Similarly, by altering the dimensions of the frustoconical section and annular section of the input conduit, the size of the comminuted particles can altered. Further, a damper could be inserted which could be actuated at the point of impact of the fan which would thus change the air flow and pressure, thus altering the comminuting properties of the invention.

It is also to be understood that comminuted materials leaving the outlet conduit of the fan housing could be rechanneled into the input conduit and be further reduced in size.

Another alternative could be the use of a direct drive motor for the fans in the invention. An example would be a 150 V.P., 445 V.P., 3600 r.p.m. vertical mill motor. Belt drive connections sometimes slip and therefore do not transfer sufficient horsepower to maintain consistent high fan speed. Also, a belt drive system has more parts and more potential for failure or wear.

Fan 250 (see FIG. 14) can be cast, either as a single unit, or in three pieces and then welded together. In the preferred embodiment, it is made of high carbon steel and has a tungsten carbide coating on a Teflon® substrate which is baked on at 2500° F. This coating further reduces any wear problems.

In the embodiments of the invention, impeller design controls final particle size A particle distribution of 5 to 50 micron particles is typical, which is a significant advance over Clute which typically produced a particle distribution of 200 to 500 micron particles for the same amount of energy input.

It is to be further understood that the present invention can be applied to other areas such as fine particle technology, biotechnology, heterogeneous combustion, multi-phase and turbulent heat transfer, pollution control, feedback control and explosion prevention. Additional industrial applications include boiler and dryer combustion chambers, asphalt/lime/cement/gypsum kiln combustion chambers, incinerator combustion chambers and ammonia reformer combustion chambers.

What is claimed is:

1. A centrifugal pneumatic comminutor comprising, a housing containing a fan mounted on a vertical axis capable of operative connection to a motor means, said housing having an inlet opening aligned with the rotational axis of said fan, and each blade of said fan having a lower portion of one length and an upper portion which has a length greater than said one length, wherein said lengths are measured radially from the rotational axis of said fan, and said upper and lower portions are joined so as to form a continuous fan structure, and said inlet opening has a diameter which is larger than twice said one length, an inlet conduit defining and extending outwardly from said inlet opening, an outlet opening, and an outlet conduit surrounding and extending outwardly from said outlet opening, an annular rotational impact zone surrounded by liner means secured to said inlet conduit at a position immediately below said fan, said liner means having a diameter which is larger than twice said one length, said liner means having an inner-facing surface, and said inner-facing surface being abrasive to promote grinding of particles being comminuted in said comminutor.

2. The comminutor of claim 1 wherein said liner means is removable and replaceable.

3. The comminutor of claim 1 wherein said liner means is made of white iron.

4. The comminutor of claim 1 wherein said inner-facing surface of said liner means includes a carbide coating.

5. The comminutor of claim 1 wherein said inner-facing surface; said convex inner-facing surface causing particles not yet comminuted to a sufficient size to be reflected or travel down said convex inner-facing surface away from said fan for further comminution, and allowing sufficiently comminuted particles to more easily travel near said fan to allow air flow to pull said sufficiently comminuted particles into said fan.

6. The comminutor of claim 5 wherein the bottom of said convex inner-facing surface of said liner means opposite from the fan is more severely sloped or rounded than the corresponding top portion nearest the fan.

7. The comminutor of claim 1 wherein said liner means comprises an uneven inner-facing surface to promote increased grinding action and to cause increased collisions of particles striking said inner-facing surface.

8. The comminutor of claim 7 wherein said uneven inner-facing surface comprises a plurality of consecutive channels generally transverse to the plane of said liner means.

9. The comminutor of claim 7 wherein said uneven inner-facing surface comprises a plurality of consecutive convex grooves generally transverse to the plane of said liner means.

10. The comminutor of claim 1 wherein said liner means is rotatable with respect to said inlet conduit, and comprises means for rotatably mounting said liner means to said inlet conduit and connection means for operable connection to a motor means to provide rotational power to said rotatable liner means, said rotational liner means being rotatable in a direction opposite to the comminution air and particle flow in said comminutor.

11. The comminutor of claim 1 further comprising a plurality of air jets mounted to said comminutor and being in fluid communication with the rotational impact zone to provide pressurized air generally tangential to said rotational impact zone and with the direction of flow of particles to increase the speed of the comminuted particles to assist in retaining the particles for a longer period in said rotational impact zone for further comminution.

* * * * *